US011430627B2

(12) United States Patent
Tootell et al.

(10) Patent No.: US 11,430,627 B2
(45) Date of Patent: Aug. 30, 2022

(54) ELECTRON SOURCE

(71) Applicant: ISOTOPX LTD., Cheshire (GB)

(72) Inventors: Damian Paul Tootell, Cheshire (GB); Anthony Michael Jones, Cheshire (GB)

(73) Assignee: ISOTOPX LTD., Cheshire (GB)

( * ) Notice: Subject to any disclaimer, the term of this patent is extended or adjusted under 35 U.S.C. 154(b) by 133 days.

(21) Appl. No.: 16/759,400

(22) PCT Filed: Oct. 26, 2018

(86) PCT No.: PCT/GB2018/053117
§ 371 (c)(1),
(2) Date: Apr. 27, 2020

(87) PCT Pub. No.: WO2019/081952
PCT Pub. Date: May 2, 2019

(65) Prior Publication Data

US 2020/0294751 A1 Sep. 17, 2020

(30) Foreign Application Priority Data

Oct. 26, 2017 (GB) ..... 1717656

(51) Int. Cl.
*H01J 27/20* (2006.01)
*H01J 1/22* (2006.01)
*H01J 1/28* (2006.01)

(52) U.S. Cl.
CPC ..... *H01J 27/205* (2013.01); *H01J 1/22* (2013.01); *H01J 1/28* (2013.01)

(58) Field of Classification Search
CPC ..... H01J 27/205; H01J 27/22; H01J 27/28
See application file for complete search history.

(56) References Cited

U.S. PATENT DOCUMENTS

| | | | |
|---|---|---|---|
| 5,594,299 | A | 1/1997 | Bossert |
| 2002/0070672 | A1 | 6/2002 | Horsky |
| 2005/0051096 | A1 | 3/2005 | Horsky |

(Continued)

FOREIGN PATENT DOCUMENTS

| | | | |
|---|---|---|---|
| JP | 61140019 | A | 6/1986 |

OTHER PUBLICATIONS

Shigehiko Yamamoto: "Fundamental physics of vacuum electron sources", Reports on Progress in Physics, Institute of Physics Publishing, Bristol, GB, vol. 69, No. I, Nov. 21, 2005.

(Continued)

*Primary Examiner* — Anne M Hines
(74) *Attorney, Agent, or Firm* — Niels Haun; Dann, Dorfman, Herrell & Skillman, P.C.

(57) ABSTRACT

An electron source in a gas-source mass spectrometer the electron source comprising: an electron emitter cathode presenting a thermionic electron emitter surface in communication with a gas-source chamber of the gas-source mass spectrometer for providing electrons there to; a heater element electrically isolated from the electron emitter cathode and arranged to be heated by an electrical current therein and to radiate heat to the electron emitter cathode sufficient to liberate electrons thermionically from said electron emitter surface, therewith to provide a source of electrons for use in ionising a gas the gas-source chamber.

15 Claims, 13 Drawing Sheets

(56) References Cited

U.S. PATENT DOCUMENTS

| | | | | |
|---|---|---|---|---|
| 2006/0097645 | A1 | 5/2006 | Horsky | |
| 2010/0130999 | A1 | 5/2010 | Wahr | |
| 2013/0240753 | A1 * | 9/2013 | Kamei | H01J 37/08 250/427 |
| 2014/0326594 | A1 | 11/2014 | Biloiu | |

OTHER PUBLICATIONS

International Search Report and Written Opinion dated Jan. 25, 2019 in Corresponmding Applciation PCT/GB2018/053117.

GB Search Report dated Apr. 25, 2018 in Corresponding Applcation GB1717656.1.

Jennifer Mabry, et al.:; Mapping changes in helium sensitivity and peak shape for varying parameters of a Nier-type noble gas ion source; J. Anal. At. Spectrom.; 2012, 27, 1012 (DOI: 10.1039/c2ja10339g).

John R. de Laeter:; Applications of Inorganic Mass Spectrometry; Iozination Methods; pp. 21-23.

Ian McDougall & T. Mark Harrison; Geochronology and Thermochronology by the 40Ar/39Ar Method; Chapter 3.17.3 'Ion Sources' pp. 78-79.

G. Brent Dalrymple & Marvin A. Lanphere; Potassium-Argon dating: Principles, Techniques and Applications to Geochronology chapters, headed 'Argon measurement, Mass spectrometers, Ion source' at pp. 69-71.

Alfred 0. Nier; A Mass Spectrometer for Isotope and Gas Analysis; The Review of Scientific Instruments, vol. 16, No. 6, p. 398, Jun. 1947.

* cited by examiner

ELECTRON SOURCE

Priority Applications

This application is a 371 application of International Application No. PCT/GB2018/053117 filed Oct. 26, 2018, which claims priority to United Kingdom Patent Application No. 1717656.1 filed Oct. 26, 2017. Each of the foregoing applications is hereby incorporated herein by reference.

FIELD

The invention relates to electron sources for providing electrons, such as in a mass spectrometer, e.g. a gas-source mass spectrometer.

BACKGROUND

Many scientific instruments depend upon the ionisation of gas molecules in order to prepare the molecules for subsequent manipulation. Electron beam bombardment is commonly used for this process. Electrons are generated by thermionic emission from a cathode, these electrons are accelerated through a volume containing the gas molecules and collisions between the electrons and gas molecules ionise a proportion of the molecules.

Conventional ion sources typically use a tungsten filament arranged in various geometries (e.g. a ribbon, a coiled wire), in which the filament also serves as a cathode and electrons are emitted from its surface. However, although this design is simple to manufacture, it has significant drawbacks which limit its performance. These drawbacks include, but are not limited to, the following.

Mechanical Instability

Heated filaments are self-supporting and prone to changing shape. This gives rise to significant variations in source behaviour which compromises data and may need the source to be opened for remedial work.

Potential Gradient

It is important for the cathode to operate at a uniform and stable electrical voltage in order to constrain the energy of thermionically generated electrons to a narrow energy band. A heated wire cathode has an inherent voltage gradient along its length due to the heating current. Thus, the applied voltage is not constant as it must be adjusted to maintain emission at the required intensity.

Operating Temperature

The high work function of these heating filaments demands a high operating temperature which promotes the formation of hydrocarbon volatiles which interfere with the gas species under study (i.e. being prepared by ionisation using the electrons).

Limited Emission Current

The relatively low emission currents achievable using this technology limit the rate of ionisation which in turn limits the sensitivity of the instrument using it. This requires users constantly to trade off sensitivity, operating temperature and time between servicing the instrument.

Limited Lifetime

Significant effort is required to establish acceptable operation of such electron sources in most vacuum instruments. Operating the heated filament/cathode of the electron source at higher temperature shortens the filament's lifetime resulting in excessive down time for servicing/replacement of the filament.

The invention aims to address one or more of these deficiencies.

SUMMARY

The proposed invention is in an alternative cathode construction in which an electron-emitter cathode is heated by a filament which is electrically isolated from the cathode. The cathode is most preferably located in a gas-source type mass spectrometer, or other gas-source type instrument for generating ionised gas for analysis. An example is the so-called Nier source mass spectrometer instrument.

In a first aspect, the invention provides an electron source in a gas-source mass spectrometer the electron source comprising: an electron emitter cathode presenting a thermionic electron emitter surface in communication with a gas-source chamber of the gas-source mass spectrometer for providing electrons there to; a heater element electrically isolated from the electron emitter cathode and arranged to be heated by an electrical current therein and to radiate heat to the electron emitter cathode sufficient to liberate electrons thermionically from said electron emitter surface, therewith to provide a source of electrons for use in ionising a gas in the gas-source chamber.

In this way, it is not necessary to pass an electrical heating current through the electron emitter surface. Instead, an electrical heating current is passed through a separate heating element which becomes heated to sufficient temperature e.g. incandescent hot, to radiate heat electromagnetically to the electron emitter cathode which is positioned adjacent to the heating element in order that it may absorb radiated heat energy and be heated remotely. By removing the need to apply a voltage across a directly electrically heated electron emitter coil, one avoids the problems associated with the potential gradient described above and the resulting variation in emitted electron energy. This provides a more homogeneous electron energy which will provide greater control of the conditions affecting ionisation probability within the source. (narrowing of $\Delta E_2$ FIG. 8B)

In addition the separation of the electrical heating aspect and the electron emission aspect of the electron source, in the invention, enables the use of much more optimal materials for thermionic electron emission which would not be suitable for heating electrically. Indeed, it has been found that electron emissions are increased by a factor of up to 5 to 10, as compared to electron emission rates from existing electrically heated electron sources operating over a comparable operation lifetime. Thus, whereas it is possible to increase electron emission rates from existing electrically heated electron sources, the great cost is that the electrically heated source will "burn out" very quickly. It will then need replacement within the mass spectrometer which will require a spectrometer to be opened up (vacuum lost) potentially causing months of down-time. High electron emission rates have been found to be achievable, according to the invention as compared to existing systems, at significantly lower operating temperatures. This has a significant practical consequence because the reduced temperature reduces the presence of hydrocarbon volatiles within the vacuum of the mass spectrometer in use. As discussed above, these hydrocarbon volatiles can become ionised within the gas-source chamber and the resulting ions to interfere with the isotope species of interest, which the mass spectrometer may be being used to study.

For example, a flow rate of electrons into, or across, the gas chamber may exceed 500 μA, or preferably may exceed 750 μA, or more preferably may exceed 1 mA, or yet more preferably may exceed 2 mA. For example, an electron flow rate may be between 500 μA and 1 mA, or may be between 1 mA and 2 mA. These electron flow rates may be achievable when the temperature of the electron emitter cathode is preferably less than 2000° C., or more preferably less than 1500° C., or yet more preferably less than 1250° C., or even more preferably less than 1000° C., such as between 750° C. and 1000° C. For example, the gas-source mass spectrometer may comprise an electron trap operable to receive electrons from the electron emitter cathode which have traversed the gas-source chamber as a current of at least 0.5 mA in response to the electron emitter cathode being heated by the heater element to a temperature not exceeding 2000° C.

The gas-source chamber may be arranged to receive electrons from said electron emitter cathode at an electron input opening shaped to form an electron beam within the gas-source chamber which is directed towards the electron trap without the use of a collimator magnet. This is because of the significantly higher electron flow rates achievable according to the invention. Collimation using collimator magnets, to increase electron beam intensity (i.e. rate of flow per unit area transverse to the beam), has been found to be no longer necessary, although embodiments of the invention may include collimator magnets if desired. Ample electron beam intensity is achievable due to the enhanced electron flow rates, according to the invention.

The electron source may include an energy controller arranged for controlling the energy of electrons output by the electron source. The energy controller may include an anode disposed between the thermionic electron emitter surface and the gas-source chamber. The energy controller may include a control unit arranged to apply a variable electrical potential to the anode for accelerating electrons emitted from the thermionic electron emitter surface in a direction towards the gas-source chamber. The energy controller may include one or more electron extraction grids disposed between the thermionic electron emitter surface and the gas-source chamber. The control unit arranged to apply an electrical potential to the electron extraction grid for attracting emitted thermionic electrons towards the grid. The grid is permeable to thermionic electrons from the electron source, and is preferably reticulated or porous or otherwise provided with through-holes arranged in communication with the thermionic electron emitter surface such that thermionic electrons attracted to the electron extraction grid are permitted to pass through the electron extraction grid from a side thereof facing the thermionic electron emitter surface to a side thereof facing the gas-source chamber. The anode is preferably arranged between the gas-source chamber and the side of the electron extraction grid facing the gas-source chamber. This permits the anode to accelerate towards the gas-source chamber those thermionic electrons which have passed through the electron extraction grid. The energy controller may include one or more electron focussing electrodes disposed between the thermionic electron emitter surface and the gas-source chamber and in tandem with the anode. The one or more focussing electrodes may define, or include, an Einzel lens for example, or other ion-optical lens arrangement. The one or more electron focussing electrodes may be disposed between the anode and the gas-source chamber, and arranged to focus thermionic electrons from the thermionic electron emitter surface into the gas-source chamber via an inlet to the latter.

Due to the improved rate of emission of electrons from the electron emitter cathode, for a given temperature of the heater element, it has been found that ample electron emission rates can be achieved at lower electrical input power levels as compared to existing electron emitter systems employing electrically heated electron emitter services/materials. For example, the electron emitter cathode may be operable to be heated by the heater element to a temperature not exceeding 2000° C. when the electrical power input to the heater element does not exceed 5 W. Preferably the electrical input power does not exceed 4 W, or more preferably does not exceed 3 W, yet more preferably does not exceed 2 W, or even more preferably does not exceed 1 W. The electrical power input to the heater element may be between about 0.5 W and about 1 W. These lower power input ratings enable the electron source to last longer, due to lower rates of cathode deterioration, and permit operation at lower temperatures with all of the attendant advantages flow from that. The lower rates of cathode deterioration provide improved uniformity of electron output improving consistency of the electron source. For example, the relatively high rates of deterioration in existing electron emitter cathodes, heated electrically, result in inconsistent cathode performance and mechanical instability as the cathode physically loses material ("burns out") in use which often causes it to progressively change shape, especially in response to being heated, which has the effect of changing the electron output performance. These problems are significantly reduced according to the present invention.

The electron emitter cathode may be selected from: an oxide cathode; an I-cathode or Ba-dispenser cathode. The electron emitter cathode may comprise a base part which bears a coating of thermionically emissive material presenting the electron emitter surface. When the electron emitter cathode comprises a base part bearing a coating, the coating may comprise a material selected from: an alkaline earth oxide; Osmium (Os); Ruthenium (Ru). The work function of the electron emitter surface, at a given temperature, may be reduced by the presence of the coating. For example, the coating material may provide a work function less than 1.9 eV at a temperature not exceeding 1000° C. When no coating is used, the work function of the electron emitter surface may be greater than 1.9 eV at a temperature not exceeding 1000° C. Many other types of possible emitter material (e.g. Tungsten, W; Yttrium Oxide, e.g. $Y_2O_3$; Tantalum, Ta; Lanthanum/Boron compounds, e.g. $LaB_6$) are available.

The base part may comprise Tungsten or Nickel. The base part may be a metallic material which separates the coating from the heater element.

Oxide cathodes are generally cheaper to produce. They may, for example, comprise a spray coating comprising (Ba,Sr,Ca)-carbonate particles or (Ba,Sr)-carbonate particles on a nickel cathode base part. This results in a relatively porous structure having about 75% porosity. The spray coating may include a dopant such as a rare earth oxide e.g. Europia or Yttria. These oxide cathodes offer good performance. However other types of cathode may be employed which may be more robust to being exposed to the atmosphere (e.g. when the mass spectrometer is opened).

So-called 'I-cathodes' or 'Ba-dispenser' may comprise a cathode base consisting of porous tungsten, e.g. with about 20% porosity, impregnated with a Barium compound. The base part may comprise tungsten impregnated with a compound comprising Barium Oxide (BaO). For example, the Tungsten may be impregnated with $4BaO.CaO.Al_2O_3$, or other suitable material.

The electron source may comprise a sleeve which surrounds the heater element, wherein the electron emitter surface resides at an end of the sleeve.

The heater element may comprise a metallic filament coated with a coating comprising a metal oxide material.

In a further aspect, the invention may provide an ion source for a mass spectrometer comprising the electron source described above. The ion source may be a gas-source (of ions) and may be, for example, a Nier-type gas-source, e.g. a Nier-type noble gas ion source.

In yet a further aspect, the invention may provide a mass spectrometer comprising a gas-source (of ions) as described above. The gas-source of the mass spectrometer may be a gas-source and may be, for example, a Nier-type gas ion source, e.g. a Nier-type noble gas ion source.

In another aspect, the invention may provide a gas-source mass spectrometer comprising an electron source as described above, in which the gas source has a gas-source chamber comprising an electron input port for receiving electrons into the gas-source chamber from the electron source, and an electron-optical part arranged between the electron source and the electron input port to urge/direct electrons from the electron source towards (e.g. collimate or converge towards) the electron input port. The electron-optical part may be an electron-optical lens such as an electrostatic lens (e.g. comprising one, two or more Einzel lenses). The electron-optical part may be disposed apart from the gas-source chamber and spaced therefrom by a distance of at least 1 cm, or at least 1.5 cm, or at least 2 cm, or at least 2.5 cm. The optical axis of the electron-optical part may be coaxial with (or at least in register with) the centre of the electron-emitter surface of the electron source. The electron-emitter surface may be substantially flat. The optical axis of the electron-optical part may be coaxial with (or at least in register with) the centre of the electron input port. The electron optical part may comprise a through-opening, or bore, for transmitting therethrough electrons from the electron source. The diameter, or width dimension, of the through-opening, or bore, may be substantially the same as, or greater than, the diameter, or width dimension, of the electron emitter surface. In this way substantially the whole of the electron emitter surface may be presented and apparent for emitting electrons into the bore of the electron-optical part.

The electron-optical part may comprise one or more electrodes (e.g. lens rings) arranged to receive one or more electrical voltages with which to generate an electric field configured to urge/direct (e.g. collimate or converge) electrons emitted from the electron source towards the electron input port. The electron-optical part may be arranged to urge/direct electrons from the electron source to form a beam of electrons that converges towards a region of minimum beam width located within the gas-source chamber. The gas-source mass spectrometer may comprise a control unit arranged to apply said one or more electrical voltages adjustably (e.g. adjustable voltage values) therewith to adjust the location of the region of minimum beam width within the gas-source chamber.

Preferably, the gas-source mass spectrometer has no magnets arranged to apply a magnetic field (e.g. electron collimating magnets) across the gas-source chamber. Accordingly, magnetic collimation of electrons from the electron source may be absent. Electron collimation may be achieved, optionally if it is desired, using the electron-optical part.

The Nier-type mass spectrometers, originally designed by Alfred Nier, are a well-known class of mass spectrometer and comprise an ion source forming ions of a sample of interest, an electrical ion accelerator/optics instrument for forming a direct beam of those ions, a magnetic sector-instrument for separating ions in the ion beam into multiple ion beams according to their mass-to-charge ratio (m/z), and an ion collector instrument for measuring the current in each ion beam. Nier-type mass spectrometers operate by ionizing a gaseous sample of interest (e.g. a Noble gas) in what has become known as a Nier-type gas ion source, and accelerating the ions from the ion source through an electrical potential difference of several kV. The accelerated gas ions are separated in-transit by passing them through a sector-shaped magnetic field region with field lines directed perpendicular to the ion trajectory. The resulting beam of ions is separated by the magnetic field according ion mass-to-charge ratio (m/z). Beams with lighter ions bend at a smaller radius within the sector-shaped magnetic field region than beams with heavier ions. The current of each ion beam is then measured using a 'Faraday cup' or a multiplier detector. The invention has particular application in, though is not limited to, Nier-type gas ion sources and Nier-type gas ion mass spectrometers.

An example of a study of the structure and performance of Nier-type gas ion source in general, may be found in: "*Mapping changes in helium sensitivity and peak shape for varying parameters of a Nier-type noble gas ion source*" by Jennifer Mabry, et al.: J. Anal. At. Spectrom., 2012, 27, 1012 (DOI: 10.1039/c2ja10339g). This exemplifies the existing prejudice for using a directly (ohmically) heated filament as a source of electrons within Nier-type gas-source designs. Other examples of this prejudice are found in "*Applications of Inorganic Mass Spectrometry*" by John R. de Laeter: Chapter 1.3.2, FIG. 1.8, p. 22 at which a schematic diagram shows just such a directly heated filament. In addition, "*Geochronology and Thermochronology by the* 40*Ar*/39*Ar Method*", by Ian McDougall & T. Mark Harrison, at Chapter 3.17.3 'Ion Sources' p. 78 explains that " . . . Electrons produced by thermionic emission from a hot filament, most commonly made of tungsten . . . ". The book "*Potassium-Argon dating: Principles, Techniques and Applications to Geochronology*" by G. Brent Dalrymple & Marvin A. Lanphere, at chapter 5, headed 'Argon measurement, Mass spectrometers, Ion source' at p. 70 states that " . . . In an electron-bombardment ion source electrons are produced by a filament, which generally is a tungsten ribbon or wire . . . ".

The present invention works against this prevailing prejudice in the art.

BRIEF DESCRIPTION OF DRAWINGS

For a better understanding of the invention, and to show how embodiments of the same may be carried into effect, reference will now be made, by way of example only, to the accompanying diagrammatic drawings in which.

DESCRIPTION OF EMBODIMENTS

Figure 1A:
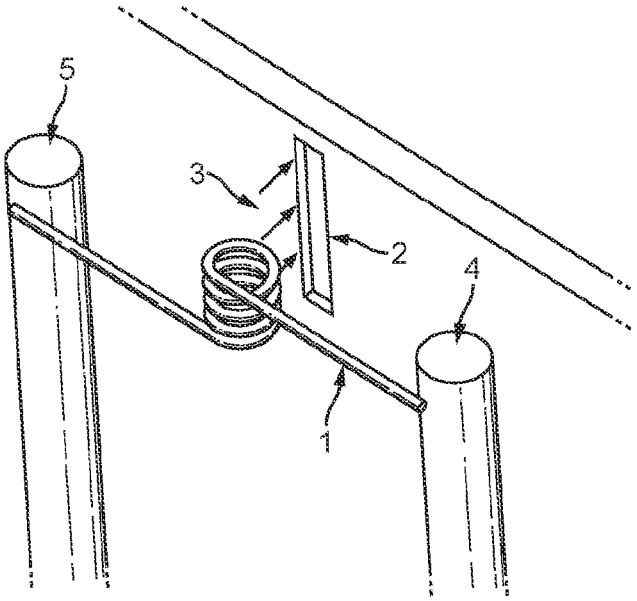
FIG. 1A schematically illustrates a tungsten filament coil electron emitter of the prior art.

FIG. 1A schematically shows an electron source according to the prior art, for a gas-source mass spectrometer. The electron source comprises a tungsten wire filament coil 1 having opposite respective wire ends electrically connected to a current input terminal 4 having a first electrical potential, and a current output terminal 5 having a second electrical potential different to the first electrical potential thereby causing an electrical current to flow through the filament coil 1. Sufficient current flows to cause the tungsten filament coil to heat (e.g. incandescently) to a temperature sufficient to cause the surface of the filament coil to emit electrons thermionically from its surface. That is to say, the thermal energy acquired by the electrical heating effect of the electrical current passing though the filament coil is sufficient to imbue electrons in the filament coil to acquire an energy exceeding the surface work function of the filament coil.

Although electrons are emitted generally omni-directionally from the filament coil 1, those electrons emitted in a preferred direction (3) are selected for input into a gas-source chamber of a gas-source mass spectrometer with which the filament coil 1 is in communication via an electron input slit 2 formed in a side wall of the chamber adjacent which the filament coil 1 is situated.

Figure 1B:
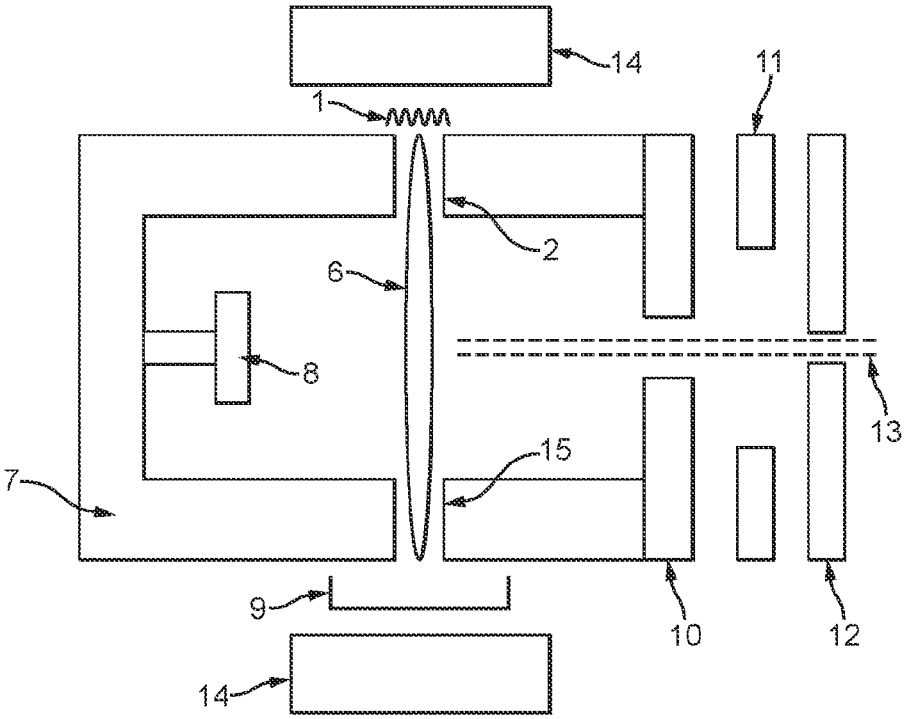
FIG. 1B schematically illustrates an ion source of a gas-source mass spectrometer, employing the electron emitter of FIG. 1A.

FIG. 1B illustrates the structure of the gas-source chamber of a gas-source mass spectrometer employing the filament coil 1. The gas-source mass spectrometer includes a gas-source block 7 within a wall of which the electron input slit 2 is formed adjacent the filament coil 1 (which is external to the gas-source block). Electrons emitted by the filament coil 1 are attracted towards the gas-source block 7 by the potential difference (negative relative to the source) used to accelerate the thermionic electrons to a desired energy. The electron voltage potential is the potential difference (in volts) between the filament and the gas-source block. Its role is two-fold: the direction of the potential field causes the electrons to accelerate towards the gas-source block; while the magnitude of the potential provides sufficient energy to cause ionisation events.

The electrons pass through a slit into the chamber of the gas-source block as an electron beam for use in ionisation of the source gas injected therein (gas injection means not shown). Electrons from the electron beam 6 are collected on the opposite side, after passing through an electron output aperture 15 formed in a wall of the gas-source block and opposing the electron input aperture. The electrons are so collected by an electron trap unit 9 held at a positive voltage relative to the source block. This electron beam traverses the chamber of the gas-source block along a beam axis which lies just behind the ion exit slit 10 so that ions which are formed by the impact of electrons on the neutral source-gas molecules can be efficiently drawn out of the chamber by the penetrating 'extraction' electric field created by Y focus plates 11. The extracted ion beam is directed to an output slit 12 formed in a plate to collimate the ion beam 13 for onward manipulation/use within the mass spectrometer.

The ion extraction field is modified by the presence of an ion repeller plate 8 inside the source block chamber. The ion repeller plate is normally operated at a negative potential to ensure that the gas ions are formed, by bombardment from the thermionic electrons of the electron beam 6, in a region of relatively low electric field gradient. The ionising electron beam 6 is constrained in its passage between the filament coil 1 and the electron trap unit 9 by the presence of two collimating magnets 14 which produce a field of over 200 Gauss parallel to the required electron beam axis. This field also serves to increase the path length of the electrons which increases the probability of impact with a gas atom/molecule, and its ionisation. The ions extracted from the ionisation region pass between the Y-focus plates 11 and are brought to a focus in the region of the defining slit 12. The image formed is normally smaller than the width of the slit 12. This reduces mass discrimination in the source due to the presence of the magnetic field from the source magnets.

Figure 3:
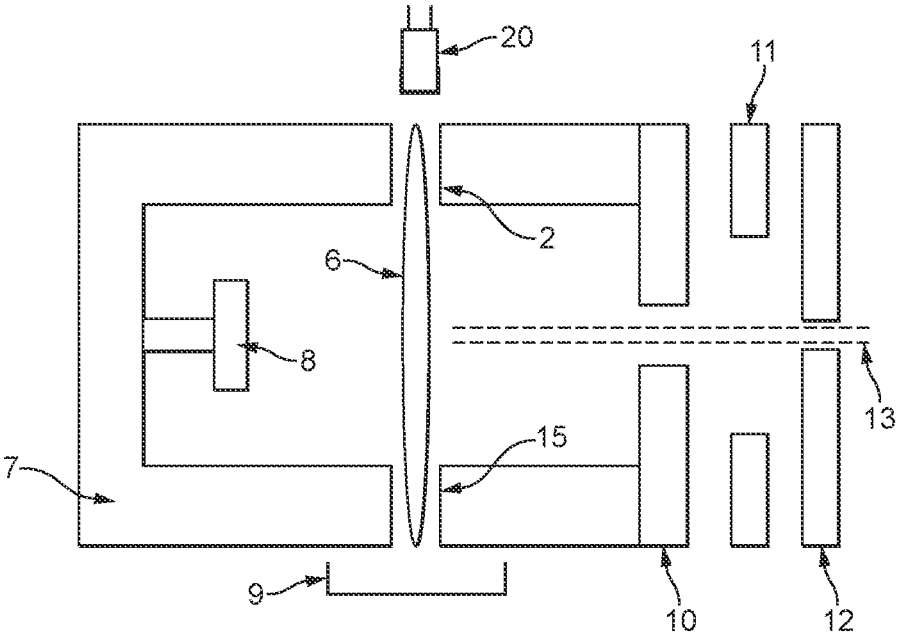
FIG. 3 schematically illustrates an ion source of a gas-source mass spectrometer, employing the electron source of FIG. 2.
Figure 7:
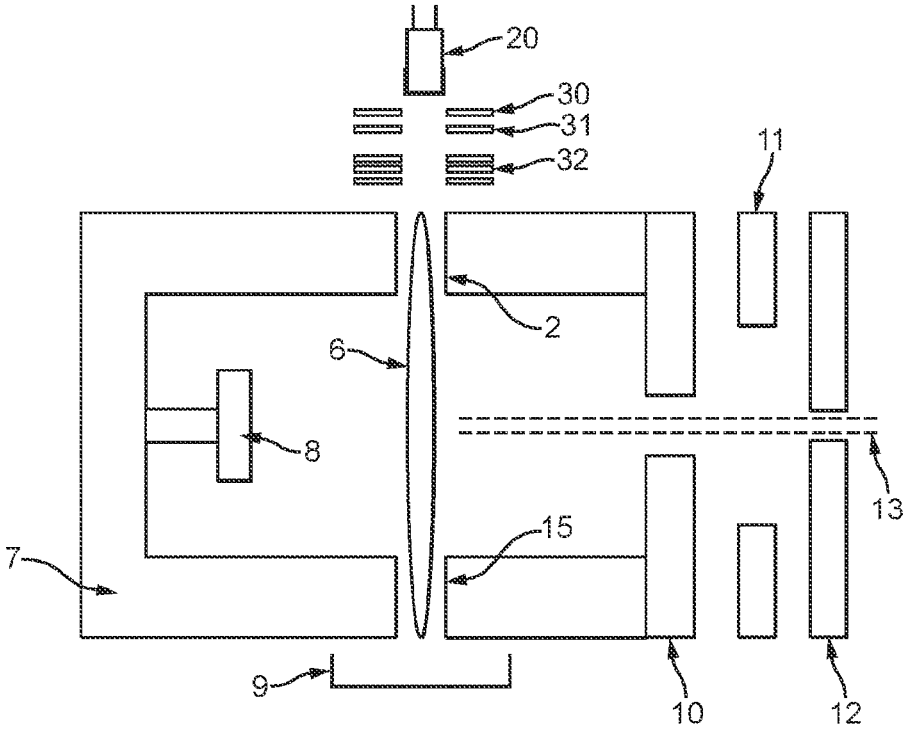
FIG. 7 schematically illustrates an ion source of a gas-source mass spectrometer, employing the electron source of FIG. 2.

A Nier-type gas ion source is a commonly used ionization source in gas mass spectrometers. A Nier-type gas source as shown in FIGS. 1B, 3 and 7, is arranged to ionize neutral gas atoms or molecules by bombarding them with electrons. In particular a stream of electrons is produced and directed to flow in to an analyte sample of gas atoms or molecules thereby to ionise them. The heated filament is held at a negative voltage (typically −50 to −100V) relative to the ionising chamber so as to accelerate electrons from the filament towards the ionising chamber. The energy of the source electrons is high enough to strip an electron from the neutral gas atoms/molecules of the analyte material. Ions produced in this way are pushed/pulled in a direction perpendicular to the path of the ionising electron beam by two sets of plates, known as the 'half-plates' 11 and the 'zero plate' 12. The half-plates are held at a voltage which is typically about 85% of the gas-source block 7.

The remaining part of the mass spectrometer for which the apparatus of FIG. 1B forms an ion source, are not shown or discussed herein, however, a detailed example of such a gas-source mass spectrometer employing an electrically heated electron source filament, is described in U.S. Pat. No. 2,490,278 (A. O. C Nier), and also in the following paper, with reference to FIG. 2 therein:

"*A Mass Spectrometer for Isotope and Gas Analysis*": Alfred O. Nier. The Review of Scientific Instruments, Volume 16, Number 6, page 398, June 1947.

It is desirable to increase the sensitivity of the mass spectrometer by creating more ionising electrons which will lead to increased precision of the measured ion beam signal. The mass spectrometer may be used to precisely measure ion beam currents. The limit to precision is governed by the size of the ion beam current relative to the noise floor of the system. Larger ion beam currents generate a higher signal/noise ratio and thus more precise data. Larger ion beams are achieved by successfully ionising more sample, so the presence of more electrons will fund this increase in ionisation. The tungsten filament 1 emits electrons by thermionic emission. Higher temperatures mean higher electron yields but this drastically reduces the life of the filament, and increases the local temperature of the source region. This can cause volatile hydrocarbon interferences to become more prevalent.

Standard operating conditions of the mass spectrometer demand a stable thermionic electron beam current to be measured by the electron trap unit 9. The magnitude and the inherent stability of the electron trap current determine the size and stability of the ion beam. The tungsten filament is operated by passing a current through the wire, and the current required to achieve a typical operational electron trap current of 200 μA is approximately 2.4 A driven at 2.5V (Total power ~6 W). Typically, the tungsten filament runs at approximately 2000° C. to get the required emission.

A mass spectrometer according to an embodiment of the invention is illustrated in FIG. 3. It differs from the arrangement of FIG. 1B in that the tungsten coil filament is replaced by a cathode filament electron source 20 which is schematically illustrated (in part cross-section) in FIG. 2. It is to be noted that the arrangement shown in FIG. 3 does not include the collimating magnets 14 of FIG. 1B. This is because of the significantly higher electron flow rates achievable according to the invention. Collimation using collimator magnets, to increase electron beam intensity (i.e. rate of flow per unit area transverse to the beam), has been found to be no longer necessary, although embodiments of the invention may include collimator magnets if desired. Ample electron beam intensity is achievable due to the enhanced electron flow rates, according to the invention.

The operation of the apparatus of FIG. 3 is otherwise the same as that of FIG. 1B, except for the operation of the cathode filament electron source 20 which is now described with reference to FIG. 2, and the absence of collimating magnets 14.

The cathode filament electron source 20 comprises a separated heater element 24 and cathode surface 26.

The electron source includes an electron emitter cathode (25, 26) presenting a thermionic electron emitter surface 25 in communication with the gas-source chamber 7 of the gas-source mass spectrometer for providing electrons 6 to it. A heater element 24 is electrically isolated from the electron emitter cathode (25,26) and arranged to be heated by an electrical current therein and to radiate heat to the electron emitter cathode sufficient to liberate electrons thermionically from the electron emitter surface. This provides the source of electrons 6 for use in ionising a gas the gas-source chamber.

A benefit of this arrangement is that the emitting surface is exposed to a more uniform acceleration potential resulting in a narrower energy spread of electrons. Consequently, most or all thermionic electrons reside at the same place, or region, within the accelerating electrical potential thereby improving the uniformity of thermionic electrons generated for use in ionising a target gas.

A electrical heating current is not passed through the electron emitter surface 26. Instead, an electrical heating current is passed through a separate heating element 24 which becomes heated to sufficient temperature, to radiate heat electromagnetically (e.g. IR radiation) to the electron emitter cathode (25, 26). The cathode absorbs radiated heat energy and emit electrons thermionically in response to that.

A flow rate of electrons across the gas chamber, in the electron beam, may exceed 500 μA or more. The flow rate of electrons across the gas chamber, in the electron beam, may be between 0.5 mA and 10 mA, e.g. 1 mA or several mA. These electron flow rates may be achievable when the temperature of the electron emitter cathode is less than 2000° C., e.g. about 1000° C. The electron emitter cathode (26, 25) is able to be heated by the heater element 24 to a temperature up to 2000° C. when the electrical power input to the heater element is less than 5 W. Indeed, typically, the electrical power input to the heater element 24 may be between about 0.5 W and about 1 W.

The electron emitter cathode (26, 25) is an oxide cathode. In other embodiments an I-cathode (also known as a Ba-dispenser cathode) may be used. It comprises a Ni base part 25 which bears a coating of thermionically emissive material 26 presenting the electron emitter surface. The coating comprises (Ba,Sr,Ca)-carbonate particles or (Ba,Sr)-carbonate particles on a nickel cathode base part. The electron source 20 comprises a Nichrome sleeve 23 which surrounds the heater element 24. The electron emitter surface 26 and base part 25, collectively reside at an end of the sleeve. The base part 25 forms a cap enclosing tat end of the sleeve. The sleeve serves to concentrate heat from the heater element upon the base part 25, which conducts heat to the emitter coating 26.

The heater element comprises a tungsten filament 21 coated with an alumina coating. This provides electrical isolation between the heating current within the heater element and the electron emitter cathode ((25, 26).

The invention offers greater electron emission at lower temperatures as compared to the tungsten filament. Typical operation requires 6.3 V at 105 mA which is approximately 0.6 W of power. The local temperature on the cathode is then about 1000° C. This produces about 1 mA of electron trap current and a corresponding 5-fold sensitivity increase of the resulting ion beam produced by electron bombardment ionisation of a source gas via the electron beam 6. The lifetime of the cathode filament electron source 20 is estimated to be more than 10 years, which far exceeds the ordinary operating lifetime of the tungsten coil filament 1, if it were to produce a comparable emission current.

Benefits of using cathode as a replacement for the tungsten filament 1 include the following.

Higher electron emissions: by a factor of about 5-10 with a comparable lifetime to the existing tungsten filament 1. The tungsten filament coil 1 may produce similar emissions but the lifetime is considerably reduced before replacement is necessary. A filament replacement potentially causes months of down-time.

Lower operating temperatures: This reduces the presence of hydrocarbon volatiles in the vacuum which are ionised and interfere with the isotope species of interest.

The higher levels of emission: This means that the external magnetic field (magnets 14) can be removed. This avoids unwanted effects of this field on the mass analyser. Ion mass discrimination between isotopes is possible, as this tends to be non-linear over a given range of partial pressures of a sample/target material.

No voltage drop across the cathode: This cannot be avoided when using the tungsten filament coil 1. This provides a more homogenous electron energy which will provide greater control on sensitivity.

Mechanical stability: This improves the consistency of the electron source and the ion source which uses it, and avoids step changes in operation during cathode lifetime.

Extended lifetime: The lower operating temperature and conservative design of the cathode 20 results in extended useful life of the cathode coupled with low rates of filament deterioration.

The results of comparative tests in a Nier source noble gas mass spectrometer instrument are illustrated with reference to FIGS. 4 to 6. These illustrate some of the benefits of the electron source of preferred embodiments of the invention, such as illustrated in FIG. 3, when compares to existing systems such as illustrated in FIG. 1B.

Figure 4:
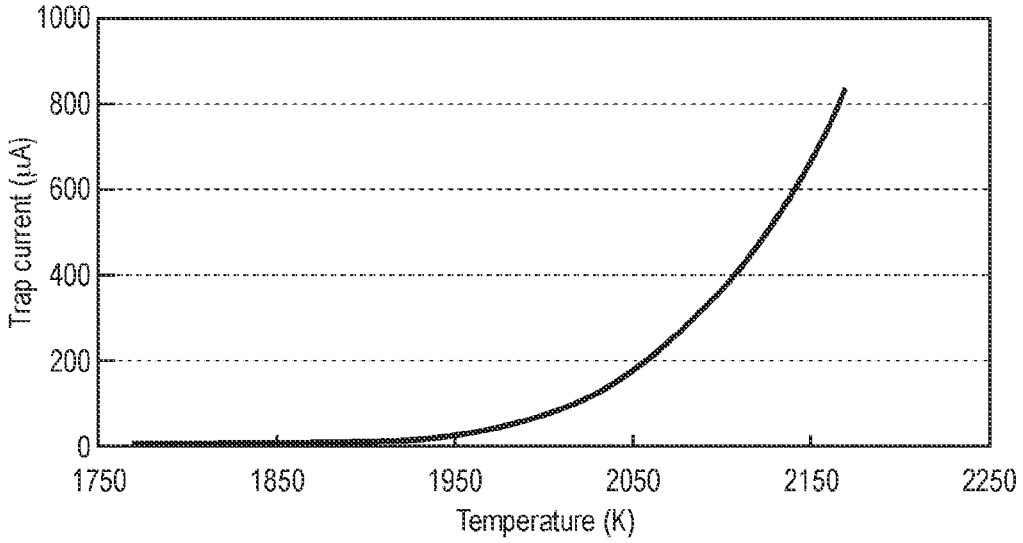
FIG. 4 shows a plot of the trap current ('ionising' current) generated by existing electrically heated filament technology (see FIG. 1B) as a function of filament temperature. Note that there is no stable region of emission over the temperature range.
Figure 5:
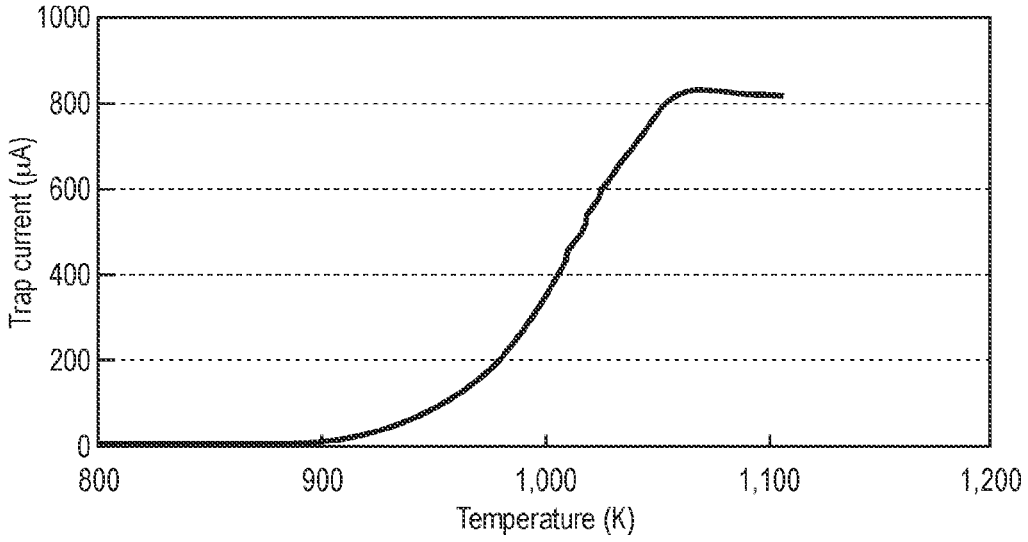
FIG. 5 shows a plot of the trap current ('ionising' current) generated by a radiatively heated filament according to an embodiment of the invention (see FIG. 3) as a function of heating filament temperature. Note, the same emission levels are achieved as the filament of FIG. 4 but at much lower temperatures, and there is also a region of stable emission at its operating current of 800 mA.
Figure 6:
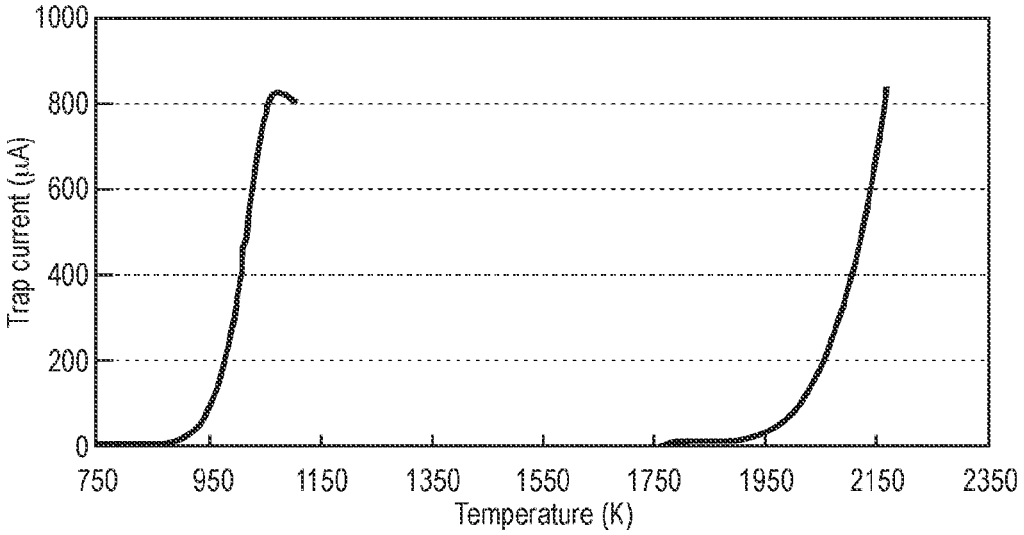
FIG. 6 shows the graphs of FIG. 4 and FIG. 5 together on the same scale to clarify the very different operating characteristics and temperatures of operation.

FIGS. 4 to 6 show the 'trap current' as a function of cathode temperature. The trap current is a fixed proportion of the total emission of the cathode and is a measure of the number of electrons flowing through the ionisation region within the source block 7, in the Nier source. Trap current was measured with high precision in a closed-loop control to stabilise operating conditions in the source.

FIG. 4 shows a plot of the trap current ('ionising' current) generated by existing electrically heated filament technology (see FIG. 1B) as a function of filament temperature. Note that there is no stable region of emission over the temperature range. FIG. 5 shows a plot of the trap current ('ionising' current) generated by a radiatively heated cathode according to an embodiment of the invention (see FIG. 2; FIG. 3) as a function of heating filament temperature. Note, the same emission levels are achieved as the filament of FIG. 4 but at much lower temperatures, and there is also a region of stable emission at its operating current of 800 μA. FIG. 6 shows the graphs of FIG. 4 and FIG. 5 together on the same scale to clarify the very different operating characteristics and temperatures of operation.

We see in FIG. 6 that the cathode 20 produces comparable levels of emission at a temperature of around 1000° C. lower than that of the tungsten filament 1. This is a significant step forward to reduce interferences from thermally derived contaminants due to stray hydrocarbons in vacuum.

To obtain the plot of FIG. 4, the tungsten filament coil 1 was driven about 400% harder than would typically be used (i.e. electron trap current is usually at about 200 μA). An electron trap current of 200 μA in the system of FIG. 1B offers a compromise between achieving an acceptable level of sensitivity (higher electron density increases ionisation allowing lower levels of sample to be detected), and longevity (higher filament currents degrade the filament 1 more rapidly). Some users of the system of FIG. 1B operate their filaments 1 at very high temperature to detect small samples, and accept the cost and disruption of downtime to replace the filament 1. The cathode 20 according to the invention may operate for many years, even at the higher 'plateau' region (e.g. 800 μA in FIG. 5) of its characteristic so it achieves high sensitivity without compromising lifetime.

Figure 2:
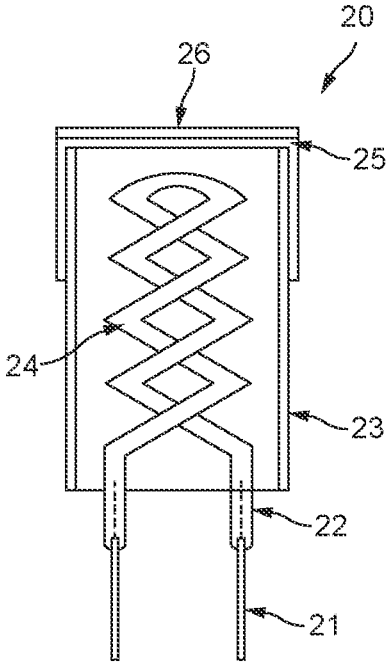
FIG. 2 schematically illustrates an electron source of a preferred embodiment of the invention.

FIG. 7 schematically illustrates an ion source of a gas-source mass spectrometer, employing the electron source of FIG. 2. This is a variant of the arrangement described with respect to FIG. 3 above.

The electron source (20, 30, 31, 32) includes an energy controller arranged for controlling the energy of electrons output by the electron source. The energy controller includes an anode (31) disposed between the thermionic electron emitter surface of the cathode (20) and the gas-source chamber. The energy controller includes a control unit (not shown) arranged to apply a variable electrical potential to the anode for accelerating electrons emitted from the thermionic electron emitter surface of the cathode in a direction towards the gas-source chamber. An electron extraction grid (30) is disposed between the thermionic electron emitter surface of the cathode (20) and the gas-source chamber. The control unit is arranged to apply an electrical potential to the electron extraction grid for attracting emitted thermionic electrons towards the grid. The grid is permeable to thermionic electrons from the electron source, and is reticulated for this purpose such that thermionic electrons attracted to the electron extraction grid are permitted to pass through the electron extraction grid from a side thereof facing the thermionic electron emitter surface to a side thereof facing the gas-source chamber.

The anode (31) is arranged between the gas-source chamber and the side of the electron extraction grid facing the gas-source chamber. This permits the anode to accelerate towards the gas-source chamber those thermionic electrons which have passed through the electron extraction grid. The energy controller includes electron focussing electrode(s) defining an Einzel lens (32) disposed between the thermionic electron emitter surface and the gas-source chamber in tandem with the anode. The Einzel lens is disposed between the anode (31) and the gas-source chamber, and is arranged to focus thermionic electrons from the thermionic electron emitter surface into the gas-source chamber as an electron beam (6) via an inlet to the gas-source chamber.

The energy controller is arranged to control the energy of thermionic electrons for input to the gas-source chamber by controlling the accelerating voltage(s) applied to the anode (31) or applied to the extraction grid (30), or both. This controllability is particularly effective and beneficial in the present invention due to the relatively narrow spread in the distribution of kinetic energy amongst the thermionic electrons emitted from the cathode (20) of the invention, as compared to the much broader corresponding distribution of kinetic energy amongst the thermionic electrons emitted from a conventional heated coil emitter.

Figure 8A:
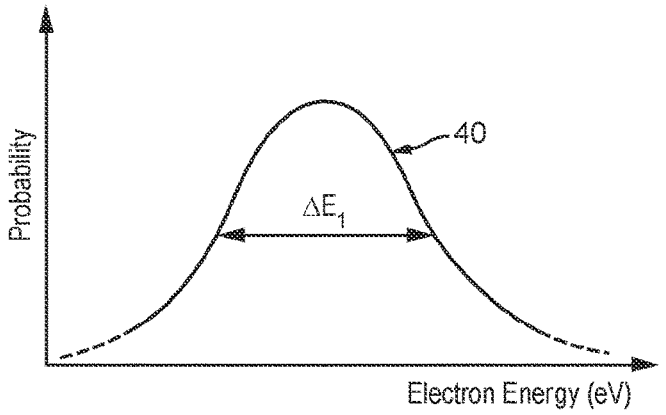
FIG. 8A schematically shows the distribution of thermionic electron energies from a heated coil electron source of the type shown in FIG. 1A.

FIG. 8A schematically shows the distribution (40) of thermionic electron energies from a heated coil electron source of the type shown in FIG. 1A. This is a broad Gaussian-like distribution caused by the non-uniform and variable voltage distribution along the length of the heated coil. The width $\Delta E_1$ (Full-Width at Half Maximum; FWHM) of this energy distribution is large, and thermionic electrons have a wide range of energies.

Figure 8B:
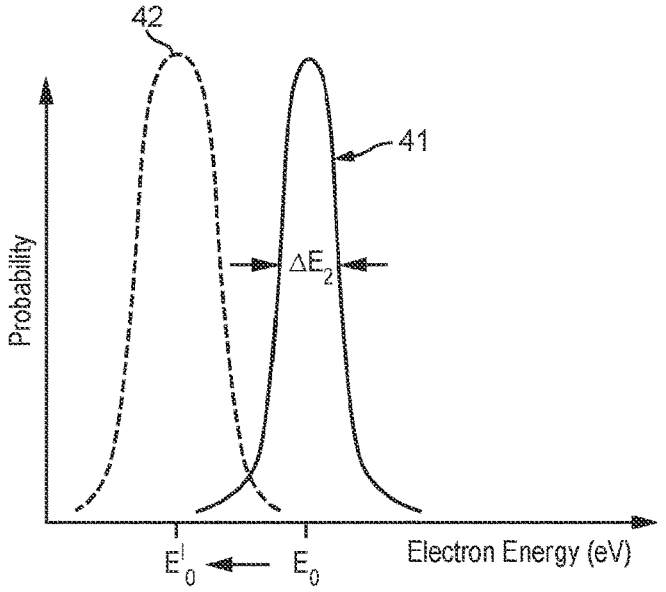
FIG. 8B schematically shows the distribution of thermionic electron energies from a heated coil electron source of FIG. 2.

FIG. 8B schematically shows the distribution (41) of thermionic electron energies from a heated coil electron source of FIG. 2. This narrow distribution has a small width $\Delta E_2$ (FWHM), and thermionic electrons have only a relatively small range of energies. The consequence is that the control unit of the energy controller may adjust the centre position ($E_0$) of the energy distribution to move it to a different (e.g. lower) centre position (e.g. shifted distribution 42, centred upon energy $E'_0$). Accordingly, the control unit of the energy controller is operable to adjust the position of the energy distribution of thermionic electrons output thereby, so as to optimise the efficiency/probability of an electron causing ionisation of atoms within a target/sample gas within the gas-source chamber.

Figure 8C:
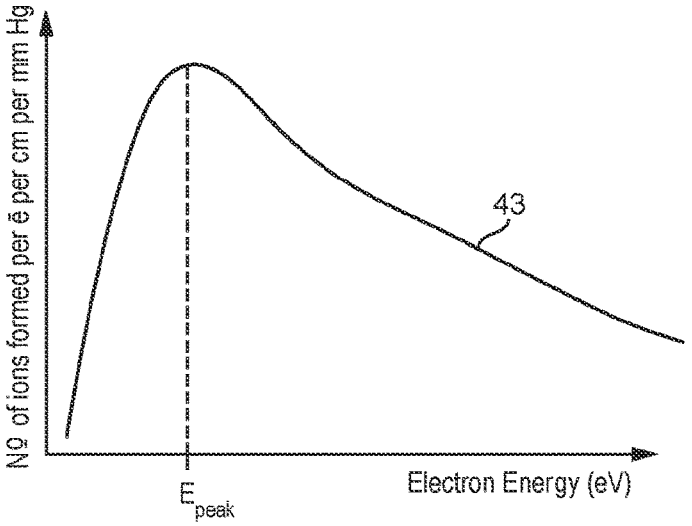
FIG. 8C schematically shows the distribution of the number of ions (per thermionic electron, per cm of electron travel, per mmHg of gas pressure) of a target/sample gas as generated by a gas-source mass spectrometer, plotted as a function of thermionic electron energy.

FIG. 8C schematically shows the distribution (43) of the number of ions produced per thermionic electron, per cm of electron travel within the gas-source chamber, per mmHg of gas pressure therein, of a target/sample gas. This ionisation rate is plotted as a function of thermionic electron energy. As can be seen, a maximum ionisation probability occurs at a thermionic electron energy ($E_{peak}$) which is relatively low in energy, and is quite a sharp peak. Ionisation probability falls away steadily and rapidly for thermionic electron energies above and below this peak energy. A particular benefit of the invention is the ability to position the relatively narrow (i.e. highly-populated) thermionic electron energy distribution of electrons from the electron source at, or near to, electron energies encompassing the maximum ionisation probability, e.g. such that energy $E'_0=E_{peak}$. The narrow distribution of thermionic electron energies (width $\Delta E_2$) allows one to better optimise the efficiency of ion production.

In gas-source mass spectrometry, ions are formed in the source by a process of electron bombardment. This process uses energetic electrons to interact with gas phase atoms/molecules to produce ions. Conventionally, the source of electrons used for this process is to electrically heat a filament so that it produces electrons by thermionic emission. The 'emission current' is the total current leaving the heated filament, whereas the flow of those energetic electrons which pass through the gas sample, and can therefore ionise it, is often referred to as the 'trap current'.

It is desirable to improve the sensitivity of gas source mass spectrometers by making the process of ionising a gaseous sample more efficient. Often, the quantity of sample material may be small or very small and maximising the ionisation of the sample is advantageous. Sensitivity is traditionally improved by collimating the electron beam using a magnetic field applied across the apparatus, and/or by increasing the trap current (i.e. more electrons to produce more ions).

However, increasing trap current requires heating the filament to ever greater temperatures. This reduces the lifetime of a filament—it literally 'boils away'. Furthermore, increased filament temperatures mean that the apparatus of the gas source is heated by radiant heat from the filament to an ever greater extent, and this promotes the release of 'background species' from the material forming the apparatus. That is to say, the material (e.g. steel, aluminium etc.) of the structural parts (e.g. walls) of the gas chamber into which the energetic electrons are directed to implement the ionisation process, will always contain some adsorbed foreign species of atoms or molecules which are released into the gas chamber when the chamber is heated. These foreign species contaminate the gaseous sample being analysed and degrade the quality of data obtained from the mass spectrometer.

The invention allows one to increase a trap current without compromising the lifetime of the electron source, and without increasing background levels of foreign species.

Figure 9:
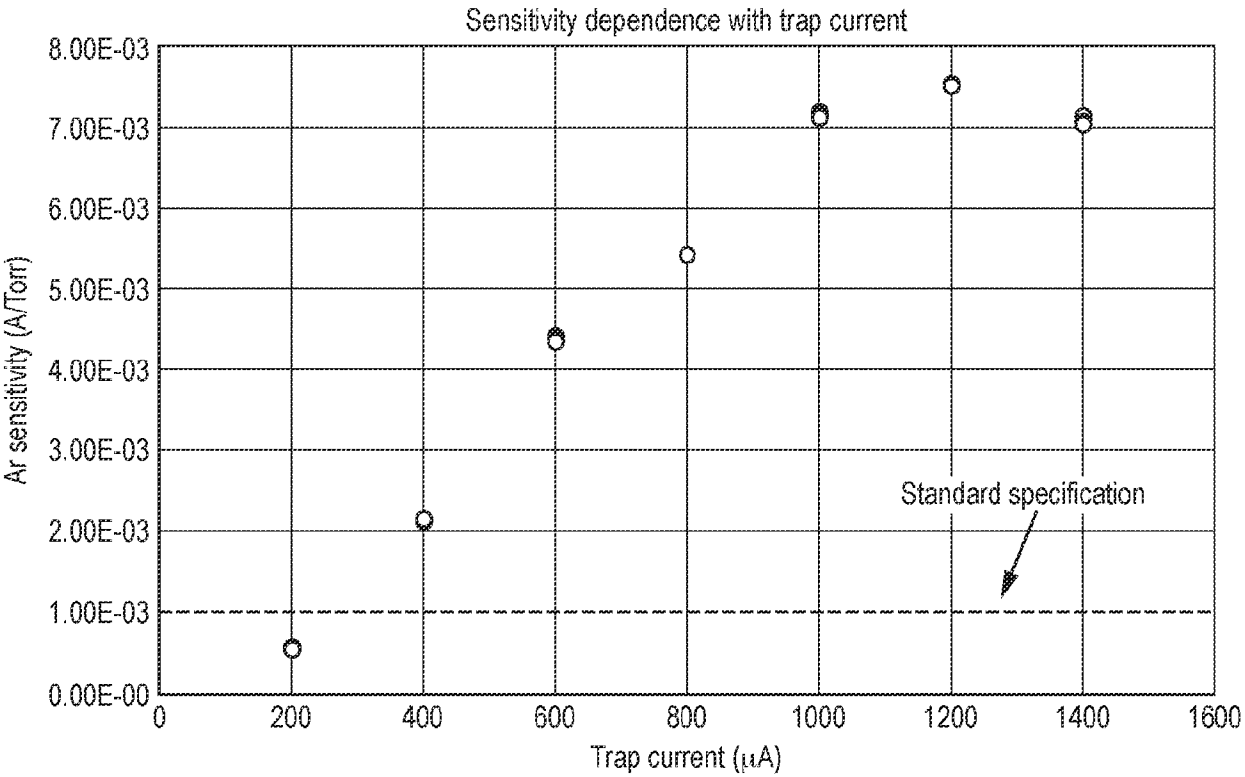
FIGS. 9 and 10 show data obtained using the invention as exemplified in embodiments described herein, applied to argon gas samples.
Figure 10:
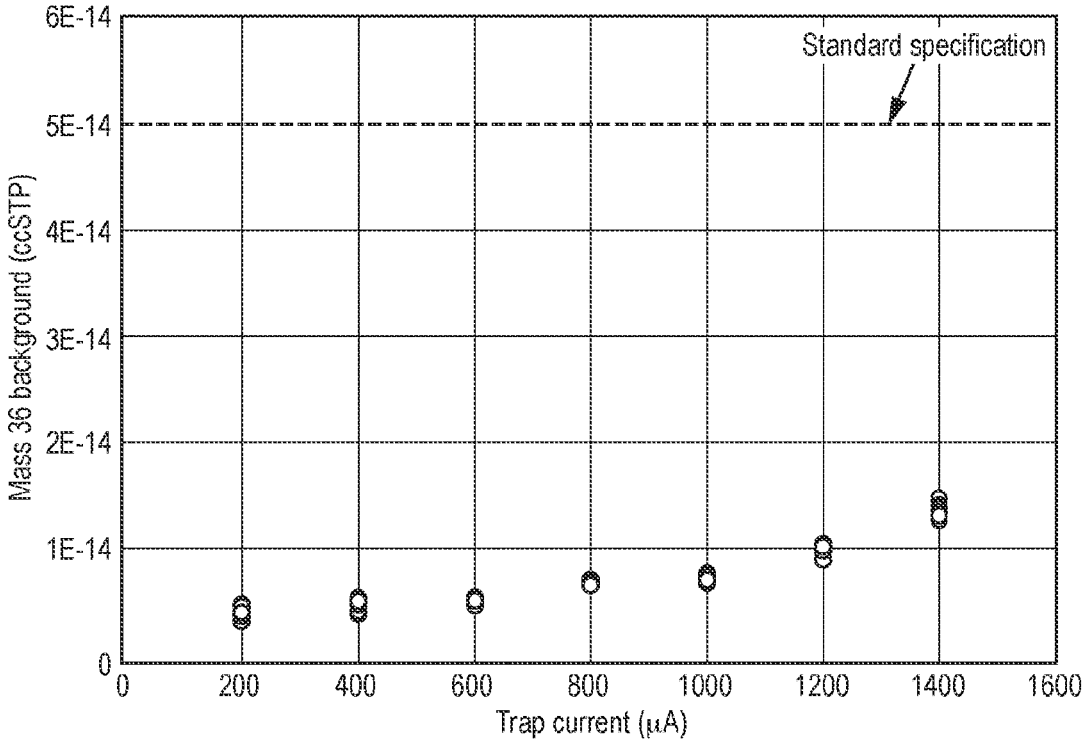

FIGS. 9 and 10 show data obtained using the invention as exemplified in embodiments described herein, applied to argon gas samples. The figures clearly illustrate the greater sensitivity achieved in conjunction with lower background levels of contaminant, provided by preferred embodiments of the invention as compared to typical levels of sensitivity and background contaminant levels achievable using existing heated filament electron sources.

In particular, with low operating temperatures of the electron source (e.g. 0.6 W), sensitivities of up to 7 mA/Torr are achieved for argon gas samples (FIG. 9) for trap currents of above about 1 mA, and this with a contaminant ('Mass 36') background concentration as low as about $1\times10^{-14}$ ccSTP (FIG. 10). These sensitivities and background concentrations are much better than standard industry levels ('Standard specification') for such measures. The lifetime of the electron source is over 3.5 years under these operating conditions. This is far longer than the expected lifetime of a typical heated filament electron source.

A traditional Nier-type electron impact/ionisation gas-source apparatus typically employs directly heated filament coils as their source of electrons. Usually, as shown in FIG. 1, the cathode is a small coil of wire, tungsten for example, which is heated to thermionic emission temperatures by the application of a suitable current.

The filament assembly has a bias voltage applied so that emitted electrons have sufficient energy to ionise analyte gas molecules. To produce sufficient electron emission, the filament needs to be heated to very high temperatures (≈1400° C.). High filament temperatures, combined with the need to position the filament extremely closely to the ionisation region, result in the source assembly temperature becoming elevated, usually between 150 and 200° C. Increased source assembly temperature increases the outgassing of contaminant background species. In noble gas analysis, where the instrument is under a static vacuum, any increase in background species is observed within the mass spectrum and especially causes problems when background ions are isobaric with analyte ions. Additional problems can arise when analyte molecules disassociate, a process linked to temperature.

In traditional Nier-type electron impact/ionisation gas sources, the thermionic electrons are emitted from the heated filament coil in all directions, and only a small proportion are transmitted into the ionisation region of the gas source apparatus. The efficiency of this process may typically be as low as a few percent of thermionic electrons ultimately entering the ionisation region. The traditional Nier-type source has collimating magnets arranged around the ionisation region to constrain thermionic electron trajectories and, by inducing a helical electron trajectory, increase the path length of the electron trajectory. Unfortunately the magnetic field produced by the collimation magnets also affects the trajectory of ions of the analyte produced in the ionisation region, and this introduces undesirable mass bias effects, most noticeable at the low end of the mass spectrum, which complicate spectral analysis of the analyte in the mass-to-charge ratio spectrum.

The voltage drop across the filament produces an electron beam with a corresponding electron energy spread. The electron energy spread could potentially transfer to the analyte ions, degrading the instrument mass resolution.

In the invention, the decoupling of the cathode (electron emitting surface) from the heater of that surface, allows that surface to be thin and flat. When disposed within an electric field for accelerating emitted electrons away from the surface, for use in analyte ionisation, substantially all parts (or most parts) of the electron emitting surface are able to reside at substantially the same electrical potential within the electric field. The effect is that the potential difference (accelerating voltage) experienced by each (or at least most) accelerated electron is substantially the same. They therefore possess substantially the same energy when entering the ionisation region of the apparatus. Put another way, the cathode voltage is able to be consistent across substantially the entire area of its electron emitting surface. This minimises the energy spread of the emitted electrons. In addition, the heater of the electron source no longer needs to be driven by a DC voltage, and AC could be used should the application require it.

In order to better illustrate the advantages and benefits of the invention when applied to a Nier-type gas source apparatus, as compared to traditional Nier-type gas sources, FIGS. 11 to 16 show the results of numerical simulations of electron trajectories within a Nier-type source of gas ions according to embodiments of the invention and also according to traditional Nier-type source designs.

Directly Heated Coil Filament—With or Without Magnetic Collimation

Figure 11:
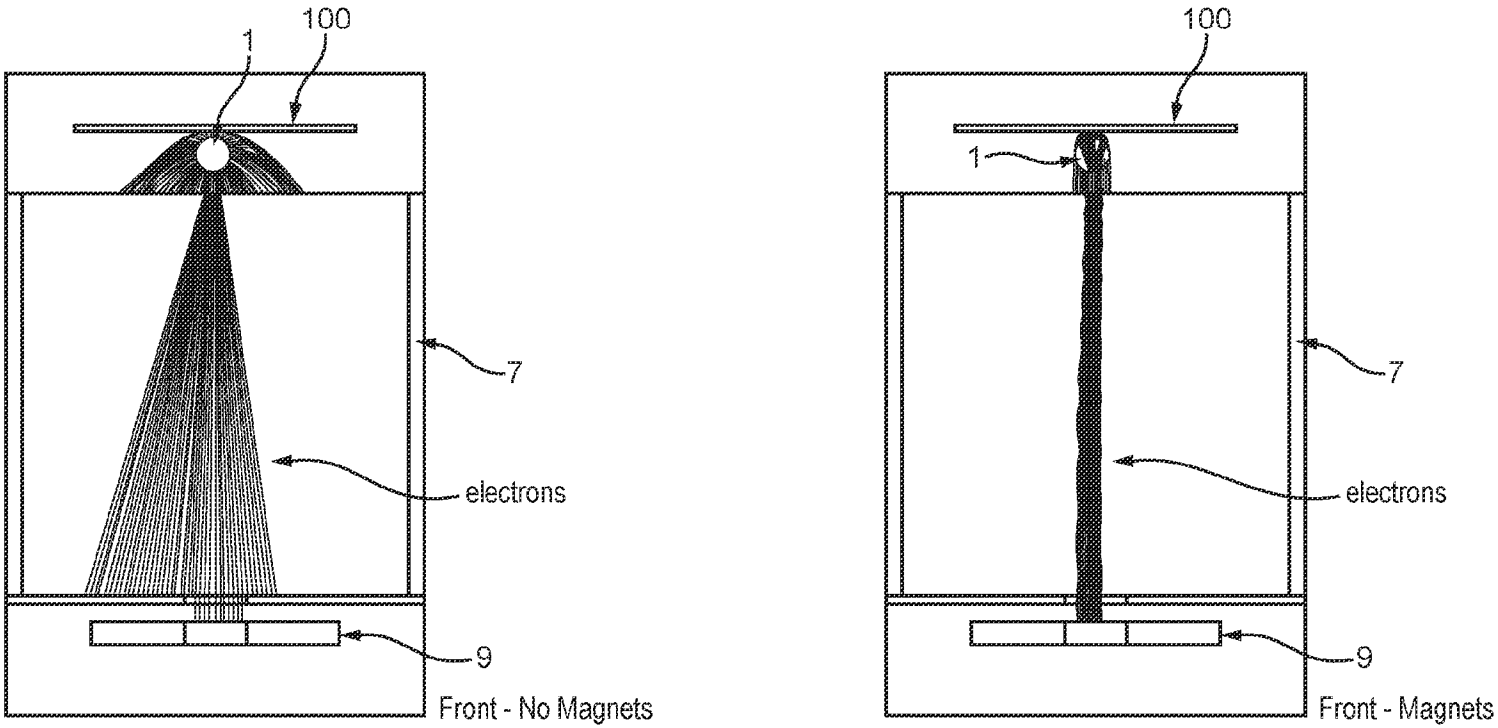
FIGS. 11 and 12 show front views (FIG. 11) and side views (FIG. 12) of the results of numerical simulations of a Nier-type source in which the electron source employed within the Nier-type source is a traditional Nier-type source design employing a directly-heated filament coil as an electron source, both with and without electron collimation magnets (not shown)
Figure 12:
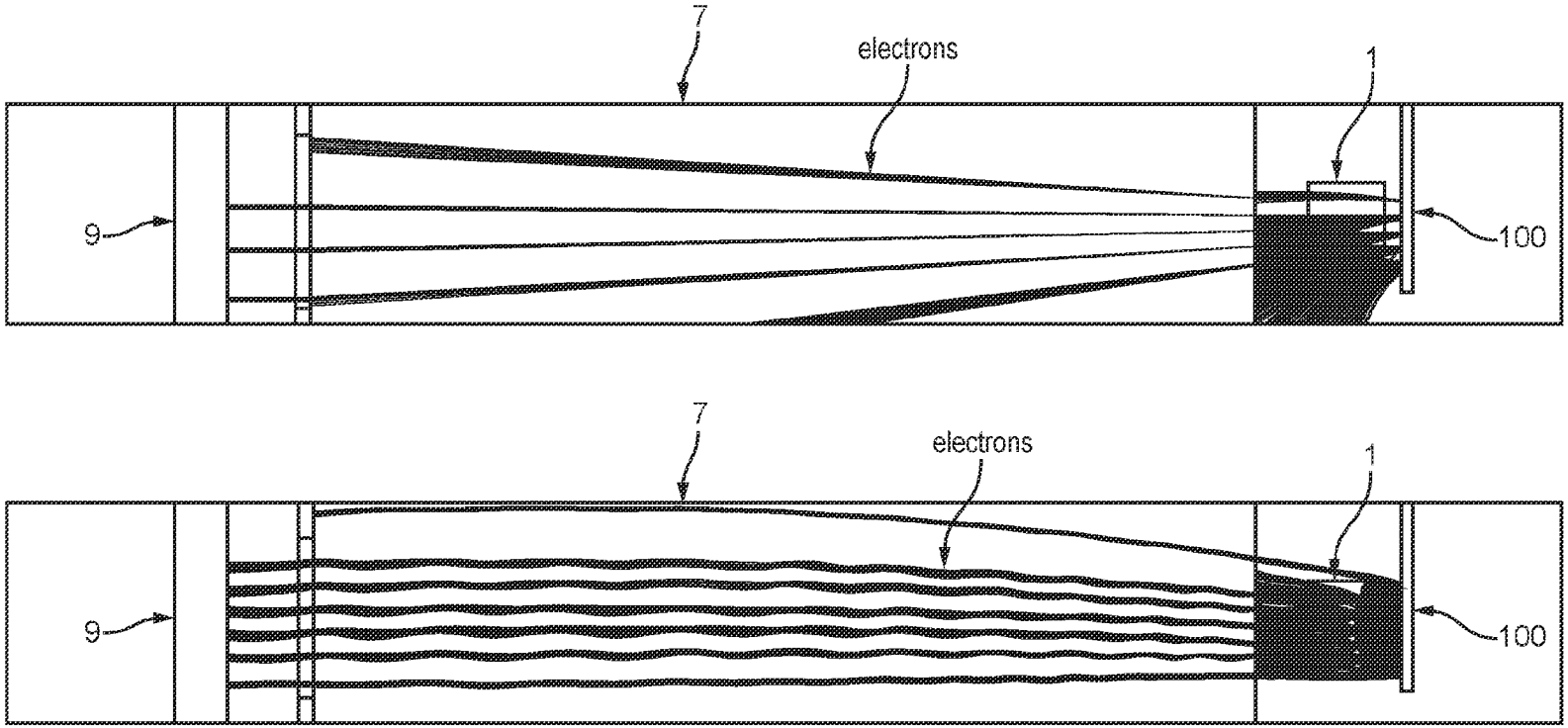

FIGS. 11 and 12 show front views (FIG. 11) and side views (FIG. 12) of a traditional Nier-type source designs employing a directly heated filament coil as an electron source, both with and without electron collimation magnets (not shown). For the purposes of better understanding, each of FIGS. 11 and 12 shows the trajectory of thermionic electrons when the magnetic field of the collimating magnet is hypothetically turned 'off' (i.e. zero magnetic field) as well as the result when the magnets are fully in effect (i.e. switched 'on' hypothetically speaking). This is in order to illustrate the collimating effect of the magnets of a traditional Nier-type source design. The voltages applied to the elements of the simulated Nier-type source structure were as shown in Table 1.

TABLE 1

| Element | Voltage (V) |
|---|---|
| Filament | −70.0 |
| Source housing | 0.0 |
| Trap | 15.0 |
| Filament cover | −68.0 |

Electron trajectories were simulated. Five groups of 300 electrons were created in the simulation, each group comprised electrons with 1 eV energy and disposed about the surface of the filament coil evenly spaced around a circle of diameter equal to the coil diameter of the filament electrode. The filament coil axis notionally extends in a direction perpendicular to the plane of the page of FIGS. 11 and 12, such that the simulated circle of electron emission positions represented one turn of that coil. The five groups of electron were distributed placed along the axis of the coil of the filament electrode at equal intervals. An estimation was obtained of the percentage of these electrons that successfully transmitted all the way through the ionisation region, and ended at the trap electrode, as shown in Table 2.

TABLE 2

| Filament | Transmission (%) |
|---|---|
| No Magnetic Field | 1.3 |
| Magnetic Field | 14 |

As expected, if no magnetic field is included in the simulation, the electrons are emitted from the filament coil in all directions, and the proportion being transmitted through the gas source chamber and all the way to the trap electrode, is very low. The application of a collimating magnetic field across the apparatus, within the simulation, provides a level of electron beam containment in addition to causing the electrons to follow a helical path. The numbers of electrons transmitted to the trap electrode is approximately ten times higher when collimating magnets are applied as compared to when they are not, in this simulation.

Indirectly Heated Cathode—With or Without Magnetic Collimation

Figure 13:
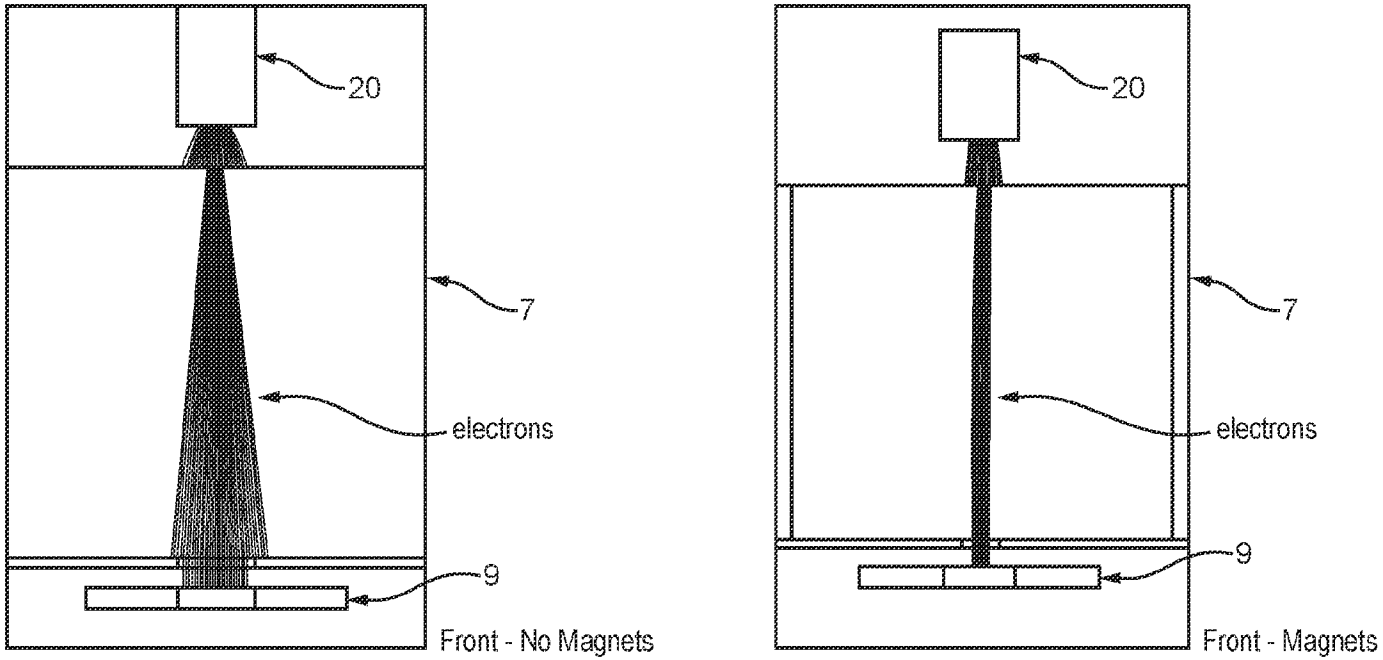
FIGS. 13 and 14 show front views (FIG. 13) and side views (FIG. 14) of the results of numerical simulations of a Nier-type source in which the electron source employed within the Nier-type source is according to the invention, and is not a directly-heated coil filament, both with and without electron collimation magnets (not shown)
Figure 14:
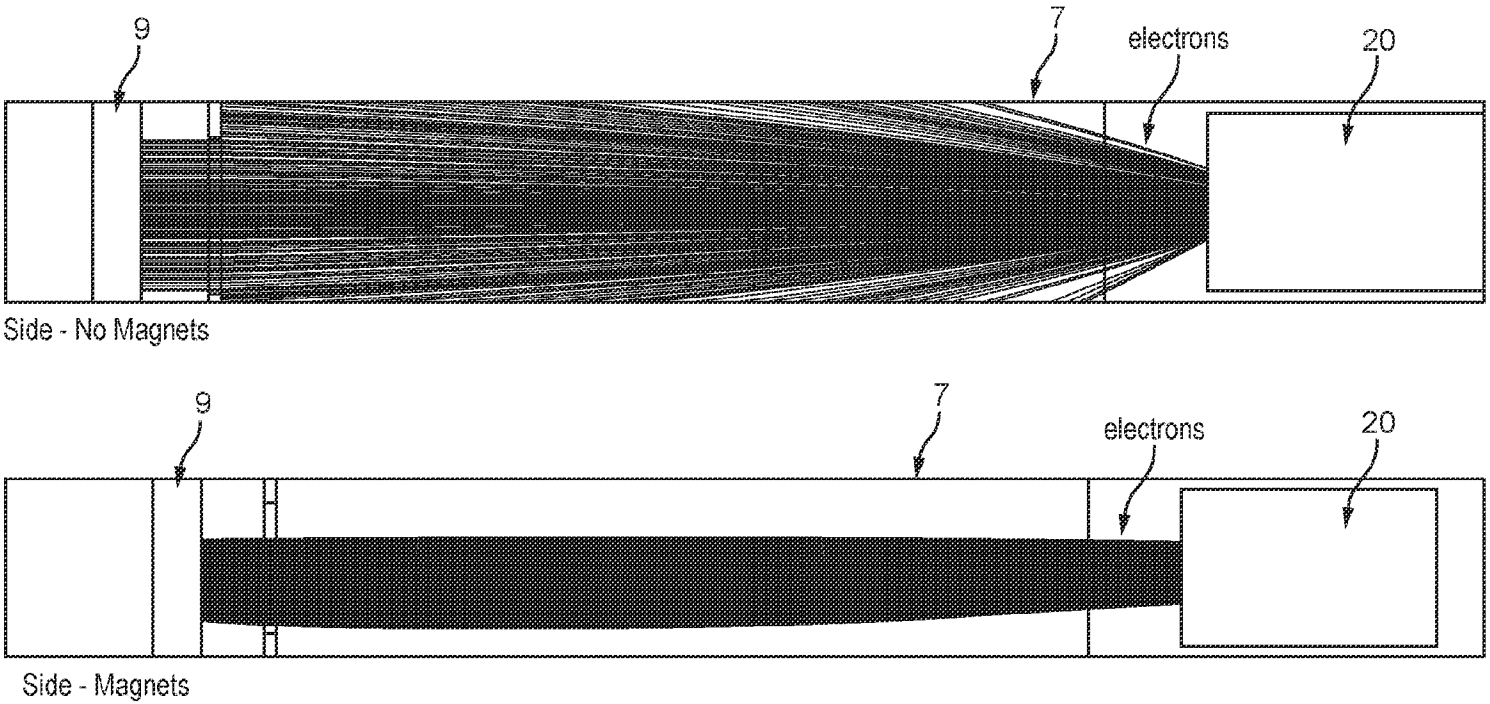

FIGS. 13 and 14 show the results of numerical simulations in which the electron source employed within the Nier-type source is according to the invention, and is not a directly-heated coil filament. The cathode part of the electron-emitting surface of the electron source was positioned 1.5 mm from the entrance aperture of the gas-source chamber/housing. Voltages were applied as shown in Table 3.

TABLE 3

| Element | Voltage (V) |
|---|---|
| Cathode | −70.0 |
| Source housing | 0.0 |
| Trap | 15.0 |

FIGS. 13 and 14 show front views (FIG. 13) and side views (FIG. 14) of the new Nier-type source design both with and without the concurrent use of electron collimation magnets (not shown). For the purposes of better understanding, each of FIGS. 13 and 14 shows the trajectory of electrons when no collimating magnet is present (i.e. zero magnetic field) as well as the result when the magnets are present and fully in effect. This is in order to illustrate the collimating effect of the magnets of a new Nier-type source design.

Electron trajectories were simulated for each electron amongst a group of 1500 electrons. Each electron was created with 1 eV energy and emitted from different respective points disposed upon the electron emitter surface (cathode) which were evenly spaced around the circular 1 mm diameter of that surface. An estimation was made of the percentage of electrons that were successfully transmitted through the ionisation region to the trap electrode, as shown in Table 4.

TABLE 4

| Existing Cathode | Transmission (%) |
|---|---|
| No Magnetic Field | 16 |
| Magnetic Field | 52 |

Due to the planar nature of the emitter surface of the electron emitter, and due to it being directed in register (facing) the entrance aperture of the gas-source chamber, a greater proportion of the emitted electrons are transmitted through the gas-source chamber to the trap electrode. Levels of electron transmission are very similar to (slightly better than) those observed in the previous example (traditional Nier-type source) in which a heated coil filament was used as the electron source in conjunction with collimation magnets. The addition of a collimating magnetic field has the collimating effect on the electron beam as is expected, such that the electron beam is constrained and a greater proportion of electrons are transmitted into and through the gas-source chamber and onwards to the trap electrode. There is approximately a threefold increase in electron transmission as compared to the case when no magnetic collimation is used.

Indirectly Heated Cathode & Einzel Lens—With and Without Magnetic Collimation

Figure 15:
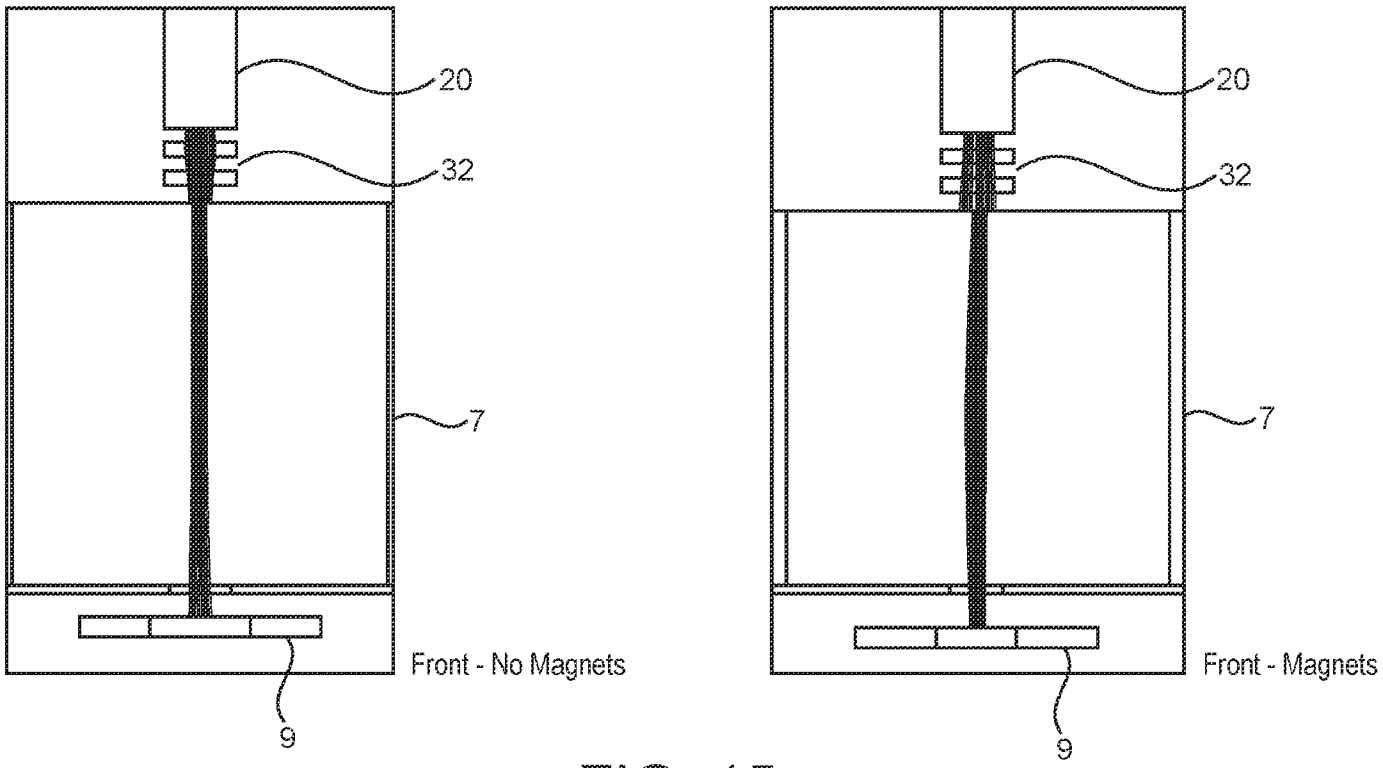
FIGS. 15 and 16 show front views (FIG. 15) and side views (FIG. 16) of the results of numerical simulations of a Nier-type source design in which the electron source employed within the Nier-type source is according to the invention, employing an Einzel lens electron focussing arrangement, both with and without the concurrent use of electron collimation magnets (not shown).
Figure 16:
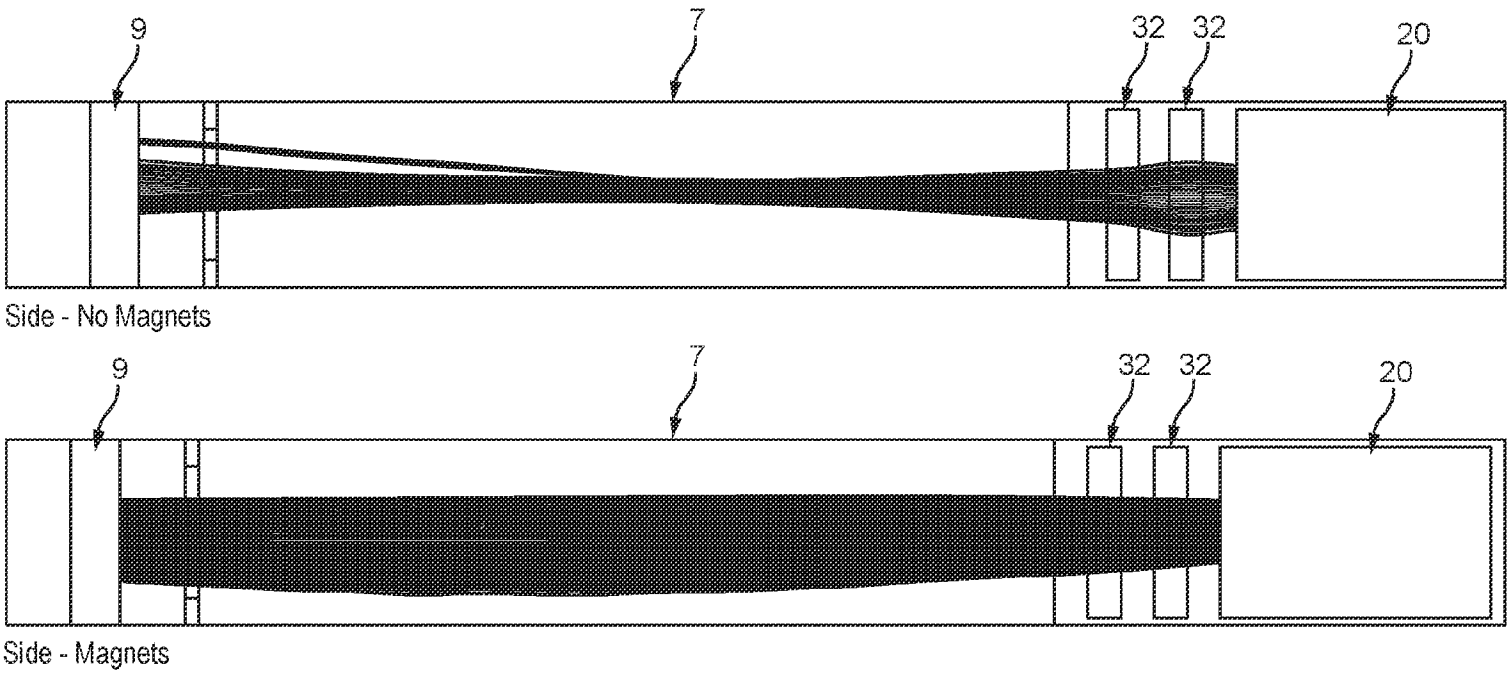

To simulate the addition of an Einzel lens to the new Nier-type gas source apparatus, two coaxially separated lens ring electrodes were added to the apparatus as shown in FIGS. 15 and 16. Each Einzel lens-ring had an inner diameter of 1.5 mm ID, an outer diameter of 2.5 mm and a thickness of 0.5 mm. The distance between the electron emitter surface (cathode) and the first lens-ring was 0.5 mm. The distance between the first lens-ring and the second lens-ring was 0.5 mm. The distance between the second lens-ring and the opposing outer face of the gas-source chamber/housing (containing the entrance aperture) was also 0.5 mm. Voltages were applied to these components as shown in Table 5.

TABLE 5

| Element | Voltage (V) |
|---|---|
| Cathode | −70.0 |
| Lens 1 | −61.0 |
| Lens 2 | 0.0 |
| Source housing | 0.0 |
| Trap | 15.0 |

FIGS. 15 and 16 show front views (FIG. 15) and side views (FIG. 16) of the new Nier-type source design both with and without the concurrent use of electron collimation magnets (not shown). For the purposes of better understanding, each of FIGS. 15 and 16 shows the trajectory of electrons when no collimating magnet is present (i.e. zero magnetic field) as well as the result when the magnets are present and fully in effect. This is in order to illustrate the collimating effect of the magnets of a new Nier-type source design.

Electron trajectories were simulated for each electron amongst a group of 1500 electrons. Each electron was created with 1 eV energy and emitted from different respective points disposed upon the electron emitter surface (cathode) which were evenly spaced around the circular 1 mm diameter of that surface. An estimation was made of the percentage of electrons that were successfully transmitted through the ionisation region to the trap electrode, as shown in Table 6.

TABLE 6

| Existing Cathode | Transmission (%) |
|---|---|
| No Magnetic Field | 82 |
| Magnetic Field | 52 |
| Magnetic Field (1%) | 80 |

As can be clearly seen, a focussing/converging effect is imposed on the trajectories of the emitted electrons by using the Einzel lens. Small changes to the voltage applied to the first Einzel lens-ring (Lens 1) have the effect of moving the focal point (or point of greatest convergence of the electron beam) closer to, or further away from, from cathode as appropriate. The voltage value indicated above was chosen so that the focal point was approximately in the centre of the gas-source chamber of the source housing.

Ions produced by energetic electron bombardment within the gas-source chamber of the apparatus, when in use within a mass spectrometer in practice, are accelerated from the source chamber through an ion exit slit (e.g. item 10: FIG. 1B, FIG. 3 or FIG. 7) to form an output ion beam (e.g. item 13: FIG. 1B, FIG. 3 or FIG. 7) using a penetrating 'extraction' electric field extending into the source chamber from external electrode plates (e.g. items 11: FIG. 1B, FIG. 3 or FIG. 7). Typically a repeller plate (e.g. item 8: FIG. 1B, FIG. 3 or FIG. 7) is provided and this may also have applied to it a voltage, relative to the source chamber, that helps to repel the positive ion beam out through the slit of the source chamber. These components of a Nier-type apparatus have a specific location relative to the ion exit slit of the source chamber where it is desirable to create ions from which to form the ion beam.

The better a Nier-type source is at constraining the region of analyte ionisation to a small location that is lined-up in register with the exit slit and/or repeller, the more effective the 'extraction' field (and/or repeller) will be at extracting those ions. This is simply because there will be less likelihood of ions 'missing' the exit slit and striking the inner walls of the source chamber—they could not contribute to the output ion beam. The intensity of the output ion beam will be increased if the location of ionisation within the source chamber can be controlled, and its ionising electrons concentrated there.

In addition, if ions are generated at widely separated regions of the 'extraction' electric field then the energy they acquire, from being accelerated by that electric field, will vary in proportion to the degree of that separation. This is undesirable as it reduces the resolution of the energy spectrum of extracted ions. The better a Nier-type source is at constraining the region of analyte ionisation to a small location within the 'extraction' electric field, the less will be the energy spread (higher resolution) of the extracting those ions.

With the new Nier-type source, which combines an indirectly-heated electron source with an Einzel focussing lens and has no magnetic collimation field, the transmission of electrons all the way through the apparatus to the trap electrode was found to be significantly greater than is the case for a traditional Nier-type source comprising a directly-heated coil filament in conjunction with collimating magnets but no Einzel lens. It is noted that the application of a collimating magnetic field was found to actually decrease electron transmission levels. The magnetic field disrupts the ability of the Einzel lens to focus the electron beam.

The concentrated and directional nature of the electron emitter according to the invention, increased the number of electrons being transmitted through the source chamber to the trap electrode. The addition of electric lensing elements between the electron emitter and the source chamber/housing, to act as an Einzel lens, successfully focussed the electron beam and increased electron transmission.

Along with the increased electron beam intensity, the removal of collimating magnet fields from the ionisation region within the source chamber reduce/eliminate mass bias effects. Focussing of the electron beam allows the electron emitter surface to be positioned even further away from the source chamber/housing. This, combined with the lower operating temperatures of the electron source permits a reduction of the heating effect caused to the source chamber/housing which reduces the outgassing of contaminants.

Although a few preferred embodiments of the present invention have been shown and described, it will be appreciated by those skilled in the art that various changes and modifications might be made without departing from the scope of the invention, as defined in the appended claims.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A gas-source mass spectrometer comprising an electron source, the electron source comprising:

an electron emitter cathode presenting a thermionic electron emitter surface in communication with a gas-source chamber of the gas-source mass spectrometer for providing electrons there to;

a heater element electrically isolated from the electron emitter cathode and arranged to be heated by an electrical current therein and to radiate heat to the electron emitter cathode sufficient to liberate electrons thermionically from said electron emitter surface, therewith to provide a source of electrons for use in ionising a gas the gas-source chamber;

an electron grid permeable to electrons and positioned to receive electrons emitted from the thermionic electron emitter surface such that electrons are permitted to pass through the electron grid from a side thereof facing the thermionic electron emitter surface to a side facing the gas-source chamber, the electron grid responsive to a voltage applied thereto; and an anode positioned to receive electrons that have passed through the electron grid and transmit the electrons received thereby to the gas-source chamber, the anode responsive to a voltage applied thereto; and an electron trap operable to receive electrons which have traversed the gas-source chamber as a current between 0.5 mA and 10 mA in response to the electron emitter cathode being heated by the heater element to a temperature not exceeding 2000° C., the electron trap having a trap current associated therewith, wherein the electron source is responsive to a measured trap current to stabilise operating conditions in the electron source with the electron grid and/or the anode configured to control the energy of thermionic electrons input to the gas-source chamber by controlling the voltages applied to the electron grid and/or the anode.

2. The gas-source mass spectrometer according to claim 1 is in which the gas-source chamber is arranged to receive electrons from said electron emitter cathode at an electron input opening shaped to form an electron beam within the gas-source chamber which is directed towards the electron trap without the use of a collimator magnet.

3. The gas-source mass spectrometer according to claim 1 in which the electron emitter cathode is operable to be heated by the heater element to a temperature not exceeding 2000° C. when the electrical power input to the heater element does not exceed 5 W.

4. The gas-source mass spectrometer according to claim 1 in which the electron emitter cathode is selected from: an oxide cathode; an I-cathode or Ba-dispenser cathode.

5. The gas-source mass spectrometer according to claim 1 in which the electron emitter cathode comprises a base part which bears a coating of thermionically emissive material presenting the electron emitter surface.

6. The gas-source mass spectrometer according to claim 5 in which said coating comprises a material selected from: an alkaline earth oxide; osmium (Os); ruthenium (Ru).

7. The gas-source mass spectrometer according to claim 5 in which the base part comprises tungsten or nickel.

8. The gas-source mass spectrometer according to claim 7 in which the base part comprises tungsten impregnated with a compound comprising barium oxide (BaO).

9. The gas-source mass spectrometer according to claim 5 in which the base part is a metallic material which separates the coating from the heater element.

10. The gas-source mass spectrometer according to claim 1 comprising a sleeve which surrounds the heater element, wherein the electron emitter surface resides at an end of the sleeve.

11. The gas-source mass spectrometer according to claim 1 in which the heater element comprises a metallic filament coated with a coating comprising a metal oxide material.

12. The gas-source mass spectrometer according to claim 1 in which the current is between 500 μA and 1 mA or between 1 mA and 2 mA.

13. The gas-source mass spectrometer according to claim 2 in which the electrical power input to the heater element does not exceed 4 W.

14. The gas-source mass spectrometer according to claim 1 in which the temperature of the electron emitter cathode is less than 1500° C.

15. The gas-source mass spectrometer according to claim 8 in which the base part comprises tungsten impregnated with $4BaO.CaO.Al_2O_3$.

* * * * *